US007276851B2

(12) United States Patent
Tanabe et al.

(10) Patent No.: US 7,276,851 B2
(45) Date of Patent: Oct. 2, 2007

(54) DISCHARGE LAMP DEVICE AND BACKLIGHT HAVING EXTERNAL ELECTRODE UNIT

(75) Inventors: Masaki Tanabe, Fukuchiyama (JP); Koichiro Matsuoka, Mukou (JP); Yusuke Mori, Fukuchiyama (JP); Hisashi Dejima, Ayabe (JP); Teruaki Shigeta, Neyagawa (JP); Norikazu Yamamoto, Yawata (JP); Nobuhiro Shimizu, Nara (JP)

(73) Assignees: West Electric Co., Ltd., Osaka (JP); Matsushita Electric Industrial Co., Ltd., Osaka (JP)

( * ) Notice: Subject to any disclaimer, the term of this patent is extended or adjusted under 35 U.S.C. 154(b) by 503 days.

(21) Appl. No.: 10/506,364

(22) PCT Filed: Apr. 17, 2003

(86) PCT No.: PCT/JP03/04875

§ 371 (c)(1),
(2), (4) Date: Sep. 2, 2004

(87) PCT Pub. No.: WO03/090252

PCT Pub. Date: Oct. 30, 2003

(65) Prior Publication Data

US 2005/0253520 A1 Nov. 17, 2005

(30) Foreign Application Priority Data

Apr. 19, 2002 (JP) ..... 2002-118353

(51) Int. Cl.
*H01J 11/00* (2006.01)

(52) U.S. Cl. ..... 313/607; 313/234; 313/594

(58) Field of Classification Search ..... 313/607, 313/234, 594
See application file for complete search history.

(56) References Cited

U.S. PATENT DOCUMENTS 3,927,342 A 12/1975 Bode et al.
4,038,577 A 7/1977 Bode et al.

(Continued)

FOREIGN PATENT DOCUMENTS

DE 196 36 965 3/1998

(Continued)

*Primary Examiner*—Joseph Williams
*Assistant Examiner*—Bumsuk Won
(74) *Attorney, Agent, or Firm*—Hamre, Schumann, Mueller & Larson, P.C.

(57) ABSTRACT

A discharge light having a light emitting tube (1) encapsulates a discharging medium, an inner electrode (2) disposed in the light emitting tube, and an outer electrode unit (4) fixed to the outside of the light emitting tube. The outer electrode unit has at least a plurality of outer electrodes (4*b*) arranged intermittently in the axial direction of the tube and having a part abutting on the outer wall face of the light emitting tube, and a part (4*c*) engaging with the light emitting tube while coupling the outer electrodes thereof integrally, wherein the engaging part clamps the light emitting tube at a part thereof thus holding the outer electrode unit around the light emitting tube. The light emitting tube is lighted by applying a voltage between the inner electrode and the outer electrode. The outer electrode can be fixed readily to the light emitting tube and the plurality of outer electrodes can be held against the light emitting tube with high accuracy.

18 Claims, 5 Drawing Sheets

U.S. PATENT DOCUMENTS

| | | | |
|---|---|---|---|
| 4,645,979 | A | 2/1987 | Chow |
| 4,899,090 | A | 2/1990 | Yoshiike et al. |
| 5,013,959 | A | 5/1991 | Kogelschatz |
| 5,117,160 | A | 5/1992 | Konda et al. |
| 5,343,114 | A | 8/1994 | Beneking et al. |
| 5,514,934 | A | 5/1996 | Matsumoto et al. |
| 5,604,410 | A | 2/1997 | Vollkommer et al. |
| 5,828,180 | A | 10/1998 | Shinada et al. |
| 5,869,931 | A | 2/1999 | Terada |
| 6,034,476 | A | 3/2000 | Tamura |
| 6,060,828 | A | 5/2000 | Vollkommer et al. |
| 6,255,782 | B1 | 7/2001 | Kuroda et al. |
| 6,331,064 | B1 | 12/2001 | Nishiyama et al. |
| 6,590,319 | B2 | 7/2003 | Moom |

FOREIGN PATENT DOCUMENTS

| | | |
|---|---|---|
| EP | 0 270 004 | 12/1986 |
| EP | 0 948 030 | 10/1999 |
| EP | 1 111 656 | 6/2001 |
| EP | 1 146 544 | 10/2001 |
| EP | 1 152 454 | 11/2001 |
| JP | 64-9356 | 1/1989 |
| JP | 1-143135 | 6/1989 |
| JP | 4-280059 | 10/1992 |
| JP | 5-29085 | 2/1993 |
| JP | 6-181050 | 6/1994 |
| JP | 7-45103 | 2/1995 |
| JP | 8-273625 | 10/1996 |
| JP | 9-161726 | 6/1997 |
| JP | 10-112290 | 4/1998 |
| JP | 10-188908 | 7/1998 |
| JP | 10-223182 | 8/1998 |
| JP | 11-86797 | 3/1999 |
| JP | 2000-106144 | 4/2000 |
| JP | 2000-259088 | 9/2000 |
| JP | 2000-285867 | 10/2000 |
| JP | 2000-353494 | 12/2000 |
| JP | 2001-143662 | 5/2001 |
| JP | 2001-210276 | 8/2001 |
| JP | 2001-237586 | 8/2001 |
| JP | 2001-243921 | 9/2001 |
| JP | 2001-243922 | 9/2001 |
| JP | 2001-325919 | 11/2001 |
| JP | 2002-42736 | 2/2002 |

DISCHARGE LAMP DEVICE AND BACKLIGHT HAVING EXTERNAL ELECTRODE UNIT

TECHNICAL FIELD

The present invention relates to a discharge lamp device for allowing an arc tube containing a discharge medium such as a rare gas to be lit by applying a voltage between an internal electrode provided in the arc tube and an external electrode provided along an outer wall surface of the arc tube. Also, the present invention relates to a backlight using the discharge lamp device.

BACKGROUND ART

In recent years, enthusiastic research has been directed to rare gas discharge lamp devices using a dielectric barrier discharge for use in backlights for liquid crystal displays or the like. Rare gas discharge lamp devices are desired for the reason that they do not exhibit a decline in luminous efficiency by a rise in mercury temperature and for environmental reasons, since they do not use mercury.

An example of rare gas discharge lamp devices using a dielectric barrier discharge is disclosed in JP 5(1993)-29085A. In the rare gas discharge lamp device disclosed in this publication, an internal electrode is provided in one end portion of an arc tube containing a rare gas, and an external electrode is provided axially on an outer surface of the arc tube. By applying a voltage to both the electrodes, phosphors in the tube are excited and emit visible radiation.

However, when this discharge lamp device is lit by a small tube current, light is not emitted throughout the whole arc tube, resulting in a partial discharge on the internal electrode side. In order to allow light to be emitted throughout the arc tube, a higher tube current is required, which leads to an increase in power consumption by the lamp, a rise in tube wall temperature, and a shortened lighting life due to an increase in sputtering of the internal electrode. Moreover, brightness declines as the distance between the internal and external electrodes becomes greater. More specifically, although high brightness can be achieved near the internal electrode where phosphors are excited easily, it becomes more and more difficult to cause excitation and thus the brightness declines gradually as the distance from the internal electrode becomes greater. As a result, brightness varies depending on the position in the arc tube.

As a solution to these problems, JP 2001-210276 A discloses a discharge lamp device in which a helical external electrode is provided on an outer surface of the arc tube containing a rare gas. The helical electrode provides a condition such that the external electrodes are arranged intermittently in the direction of the tube axis, which allows uniform charge to be obtained throughout the arc tube. Thus, the problems as mentioned above are solved.

However, in order to provide a helical external electrode, it is not easy to attach such an electrode to the arc tube. Practically, a configuration is required for positioning and holding the helical external electrode accurately relative to the arc tube and the internal electrode, which contributes to an increase in manufacturing costs. For these reasons, the external electrode that has the same function as the helical external electrode and is attached to the arc tube easily and reliably is desired.

On the other hand, to make backlights thinner, arc tubes with a smaller diameter (outer diameter), that is, thinner arc tubes, are desired. When the inner diameter of the arc tube is reduced with the tube diameter, an emission area decreases and the lamp efficiency declines. Such a tendency is shown in FIG. 7. Thus, even when the tube diameter is reduced, the inner diameter should be maintained, which means the wall thickness of the arc tube has to be reduced relatively. However, when the wall thickness of the arc tube is reduced, a lamp current increases, and thus the discharge becomes unstable and the lamp efficiency declines. FIG. 8 shows such a tendency for the lamp efficiency to decline with a reduction in wall thickness of the arc tube. This tendency is attributed to the fact that the capacitance of a dielectric layer formed by the glass wall of the arc tube increases as the dielectric layer becomes thinner. Thus, in order to reduce the diameter of the arc tube, it is desirable to provide a configuration for suppressing an increase in the capacitance of the dielectric layer.

DISCLOSURE OF INVENTION

In view of the above-described problems, it is an object of the present invention to provide a discharge lamp device in which plural external electrodes are attached to an arc tube easily and can be held relative to the arc tube accurately.

It is another object of the present invention to provide a discharge lamp device that allows the diameter of the arc tube to be reduced without substantially increasing the capacitance of a dielectric layer and thus can realize a thin backlight without decreasing the lamp efficiency.

A discharge lamp device of the present invention includes: a cylindrical arc tube containing a discharge medium; an internal electrode provided in the arc tube; and an external electrode unit attached to an outside of the arc tube. The external electrode unit includes: external electrodes arranged intermittently at plural places in a direction of a tube axis, each having a part adjoining an outer wall surface of the arc tube; and an engaging part that integrally links the external electrodes and is engaged with the arc tube, and a part of the engaging part holds the arc tube, so that the external electrode unit is held around the arc tube. A voltage is applied between the internal electrode and the external electrode, thereby lighting the arc tube.

According to this configuration, the external electrode unit integrates the external electrodes and can be held around the arc tube by itself. Therefore, the plural external electrodes can be attached to the arc tube easily and can be held relative to the arc tube accurately. Further, it is easy to place a dielectric member or the like between the arc tube and the external electrode as described later.

In the above-described configuration, the external electrode unit may be formed as an electrode member incorporating the external electrodes and the engaging part and be shaped to cover half or more of the arc tube in a circumferential direction.

Preferably, a dielectric member is interposed between the arc tube and the external electrode unit. According to this configuration, both the glass wall of the arc tube and the dielectric member serve as a dielectric barrier when the arc tube is lit. Therefore, the capacitance of the dielectric layer decreases, and the luminous efficiency is increased as compared with the case where only the arc tube is used. Further, when a material having a lower dielectric constant than the glass of the arc tube is used as the dielectric member, an increase in the capacitance caused by reducing the glass wall thickness can be compensated by the dielectric member that is thinner than the amount of reduction of the glass wall thickness. As a result, the thickness of the dielectric layer as the sum of the glass wall thickness of the arc tube and the thickness of the dielectric member can be reduced, and the overall thickness of the discharge lamp device can be reduced accordingly.

The external electrode may be made of conductive metal, be attached to an outside of the dielectric member, and have a part in contact with the dielectric member. It is preferable that an area of a portion where the dielectric member and the outer wall surface of the arc tube are in contact with each other is equal to or less than 50% of a surface area of the arc tube. Further, it is preferable that the external electrode unit is elastic and presses the dielectric member against the outer wall surface of the arc tube.

In the above-described configuration, the electrode member incorporating the external electrodes and the engaging part may be arranged inside the dielectric member by insert molding.

In the above-described configuration, the external electrode unit may include the engaging part made of a dielectric material shaped to cover half or more of the arc tube in a circumferential direction, and the external electrode may be held in a central region of the engaging part in a circumference direction of the arc tube.

In the above-described configuration, it is preferable that the dielectric member is elastic and presses the outer wall surface of the arc tube. This allows the external electrode to be held relative to the arc tube more reliably. Further, it is preferable that at least a part of the dielectric member reflects light emitted from the arc tube in a specific direction. With this configuration, emitted light can be directed easily.

At least a part of the dielectric member may be made of a light blocking material. Alternatively, a portion of the dielectric member that is not in contact with the external electrode may be made of a shielding material. Alternatively, at least a part of an outer surface of the dielectric member may be uneven, whereby heat dissipation properties can be increased. Alternatively, a thickness of the dielectric member may be changed partially, whereby an adjustment for uniform emission can be performed.

It is preferable that an interval between the external electrodes in the direction of the tube axis is not less than 1.0 mm nor more than 50 mm. Further, it is preferable that the discharge medium is an inert gas including at least one of xenon, krypton, argon, neon, and helium. With this configuration, the influence of disposal of the device on the environment can be suppressed easily. Further, the discharge medium further may include mercury, whereby the luminous efficiency and brightness can be increased. Further, a phosphor layer may be adhered to an inner wall surface of the arc tube.

A backlight of the present invention includes: the discharge lamp device having any one of the above-described configurations; and a light control member for causing light generated by the discharge lamp device to spread out into a planar form. The light control member may be a light guide element or a light reflector.

BEST MODE FOR CARRYING OUT THE INVENTION

Embodiment 1

Figure 1A:
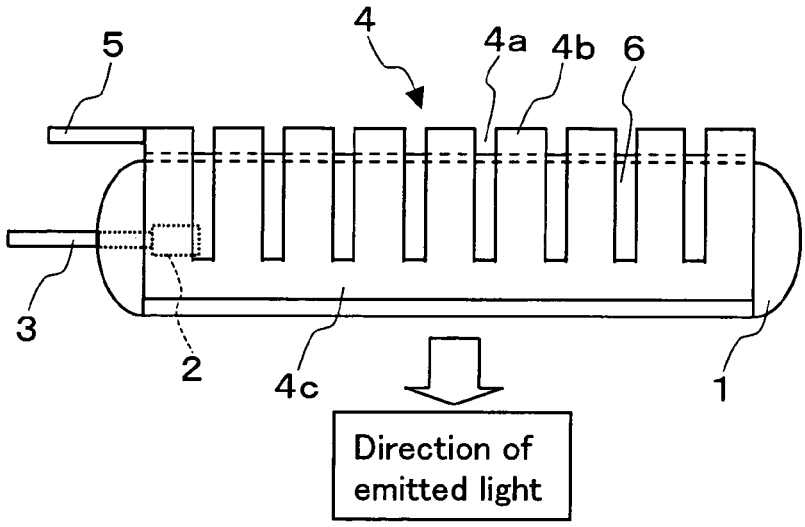
FIG. 1A is an elevational view illustrating a discharge lamp device according to Embodiment 1.
Figure 1B:
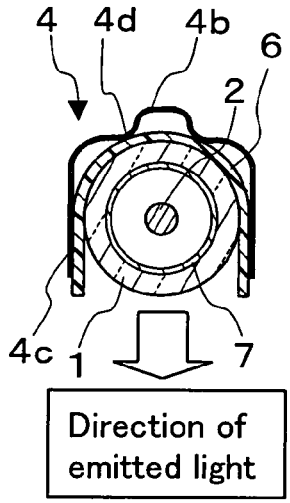
FIG. 1B is a transverse cross-sectional view of the discharge lamp device at its midsection.

FIG. 1A is an elevational view illustrating a discharge lamp device according to Embodiment 1, and FIG. 1B is a transverse cross-sectional view of the discharge lamp device at its midsection. An arc tube 1 is made of a cylindrical glass and contains a discharge medium. The arc tube 1 is, for example, 2.6 mm in outer diameter and 2.0 mm in inner diameter. As the discharge medium, about 160 Torr of mixed gas containing 60% xenon gas and 40% argon gas is contained. An internal electrode 2 made of nickel or the like is provided in the arc tube 1 and is led out electrically to the outside of the arc tube 1 by a lead wire 3.

An external electrode unit 4 is made of a phosphor bronze sheet having spring characteristics (elasticity) and is attached to the arc tube 1 so as to cover the arc tube partially in a circumferential direction (see FIG. 1B). A lead wire 5 extends from the external electrode unit 4. A dielectric member 6 is provided between the arc tube 1 and the external electrode unit 4 to cover about half of the arc tube 1 in a circumferential direction. The dielectric member 6 is pressed against the outer wall of the arc tube 1 by the external electrode unit 4. Numeral 7 denotes a phosphor layer provided on the inner wall surface of the arc tube 1.

A phosphor bronze sheet forming the external electrode unit 4 has plural separating grooves 4*a*, each extending in a circumferential direction. By the separating grooves 4*a*, plural external electrodes 4*b* separated in a direction of the tube axis are formed. The separating groove 4*a* is formed so as not to reach both ends of the external electrode unit 4 in a circumferential direction, whereby a pair of linking parts 4*c* extending in the direction of the tube axis is left. The linking parts 4*c* link the plural external electrodes 4*b*, thereby maintaining the unity of the external electrode unit 4. Each of the plural external electrodes 4*b* is formed so that a part of its cross section is recessed to form an adjoining part 4*d* (see FIG. 1B) where an inner surface of the external electrode adjoins the outer wall surface of the arc tube 1. The linking parts 4*c* electrically connect the external electrodes 4*b* at a portion away from the adjoining parts 4*d*.

According to the configuration as described above, the external electrode unit 4 functions as an external electrode via the dielectric member 6 only at the adjoining parts 4*d* arranged intermittently at plural places in the direction of the tube axis. For example, the plural external electrodes 4*b* are about 3 mm wide and are arranged at about 1 mm intervals (gaps) in the direction of the axis of the arc tube 1. A pair of the linking parts 4*c* face each other with the arc tube 1 therebetween, so that the arc tube 1 is pressed and held therebetween. Thus, the external electrode unit 4 is held around the arc tube 1. As described above, the linking parts 4*c* not only connect the external electrodes 4*b* electrically but also serve as an engaging part for engaging the external electrode unit 4 with the arc tube 1.

The dielectric member 6 is made of a polyester resin sheet having a multilayer film structure and about 70 μm thick, for example. This sheet is white and has a visible light reflectance as high as about 98%.

Figure 2:
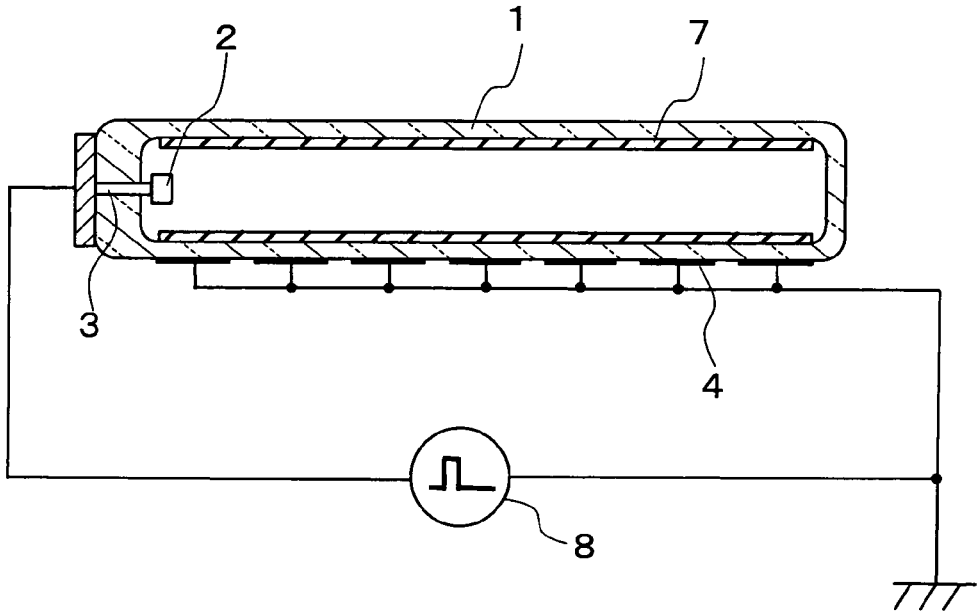
FIG. 2 is a diagram schematically illustrating the state where the discharge lamp device according to Embodiment 1 is connected to a ballast circuit.

FIG. 2 is a diagram schematically illustrating the state where the discharge lamp device configured as above is connected to a ballast circuit 8. A high-frequency rectangular wave voltage (to be specific, the frequency is 30 kHz; the voltage peak is ±1 kV between +Vp and −Vp, for example) is applied between the internal electrode 2 and the external electrode unit 4 from the ballast circuit 8. Consequently, the high-frequency voltage is applied to the xenon-argon mixed gas as a discharge medium in the arc tube 1 via the glass of the arc tube 1 as a dielectric, so that a discharge is caused. As the result of the discharge, the xenon gas is ionized and excited to generate ultraviolet radiation ($\lambda p$=172 nm). The ultraviolet radiation is radiated to the phosphor layer 7 provided on the inner wall surface of the arc tube 1, so as to be converted into visible radiation and emitted to the outside of the arc tube 1.

Since the dielectric member 6 is provided between the arc tube 1 and the external electrodes 4*b* in this discharge lamp device, the glass wall of the arc tube 1 and the dielectric member 6 serve as a dielectric barrier when the arc tube is lit. That is to say, the thickness of the dielectric layer serving as a dielectric barrier is the sum of the glass wall thickness of the arc tube 1 and the thickness of the dielectric member 6. Therefore, the capacitance of the dielectric layer decreases, and the luminous efficiency is increased as compared with the case where only the arc tube 1 is used.

When a material having a lower dielectric constant than the glass of the arc tube 1 is used as the dielectric member 6, an increase in the capacitance caused by reducing the glass wall thickness can be compensated by the dielectric member 6 that is thinner than the amount of reduction of the glass wall thickness. As a result, the thickness of the dielectric layer as the sum of the glass wall thickness of the arc tube and the thickness of the dielectric member 6 can be reduced, and the overall thickness of the discharge lamp device can be reduced accordingly.

Moreover, since the dielectric member 6 has a high visible radiation reflectance as described above, light emitted from the arc tube 1 strongly is directed in a specific direction as shown in FIGS. 1A and 1B (in a downward direction in the drawings). This characteristic has an effect in increasing the brightness of the emission surface particularly when the thus-configured discharge lamp device is used in a backlight with a light guide plate. Instead of the dielectric member 6 having itself a high visible radiation reflectance, a reflecting layer made of another material may be formed on the inner surface of the dielectric member 6.

As described above, the external electrode unit 4 in the discharge lamp device according to the present embodiment integrates the external electrodes 4*b* and can be held around the arc tube 1 by itself. Accordingly, the external electrode unit 4 can be attached to the arc tube 1 easily, and the plural adjoining parts 4*d* can be held relative to the arc tube 1 accurately.

Further, the dielectric member 6 easily can be placed between the arc tube 1 and the external electrode unit 4. Therefore, the luminous efficiency can be increased, and emitted light can be directed easily.

Embodiment 2

Figure 3A:
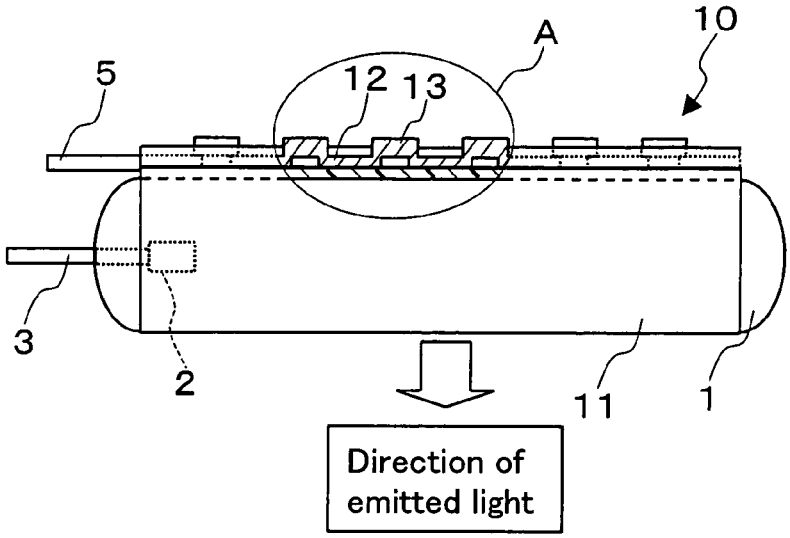
FIG. 3A is an elevational view illustrating a discharge lamp device according to Embodiment 2.
Figure 3B:
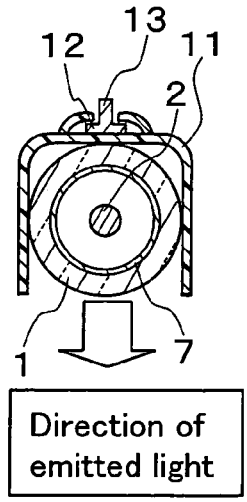
FIG. 3B is a transverse cross-sectional view of the discharge lamp device at its midsection.

FIG. 3A is an elevational view illustrating a discharge lamp device according to Embodiment 2, and FIG. 3B is a transverse cross-sectional view of the discharge lamp device at its midsection. The cross section of the device is shown for Region A in FIG. 3A. An arc tube 1 has the same configuration as described in Embodiment 1. An external electrode unit 10 includes an engaging member 11 made of a dielectric material, and plural external electrodes 12 held on the engaging member 11. The plural external electrodes 12 are connected electrically to each other by a connection part 13. The engaging member 11 is shaped to cover half or more of the arc tube 1 in a circumferential direction (see FIG. 3B). The external electrodes 12 are made of a phosphor bronze sheet and are held in a central region of the engaging member 11 in a circumferential direction of the arc tube 1.

The dielectric material of the engaging member 11 may be a polyester resin having a multilayer film structure, be white, and have a high visible radiation reflectance. Further, the engaging member 11 has spring characteristics (elasticity), and this elasticity allows the arc tube 1 to be pressed and held by the engaging member 11. Also, due to the elasticity of the engaging member 11, the external electrodes 12 are held and fixed relative to the arc tube 1 reliably. The external electrodes 12 are held so as to adjoin the arc tube 1 via the engaging member 11 made of the dielectric material. For example, the external electrodes 12 are about 3 mm wide in the direction of the axis of the arc tube 1, are arranged at about 1 mm intervals (gaps), and are connected electrically at portions where they do not adjoin an outer wall surface of the arc tube 1.

According to this configuration, the external electrodes 12 are held and fixed on the engaging member 11 previously. Thus, by setting the engaging member 11 around the arc tube 11, the external electrodes 12 also can be incorporated in the discharge lamp device.

According to the discharge lamp device configured as above, the same operation and effects as in Embodiment 1 can be achieved.

Embodiment 3

Figure 4A:
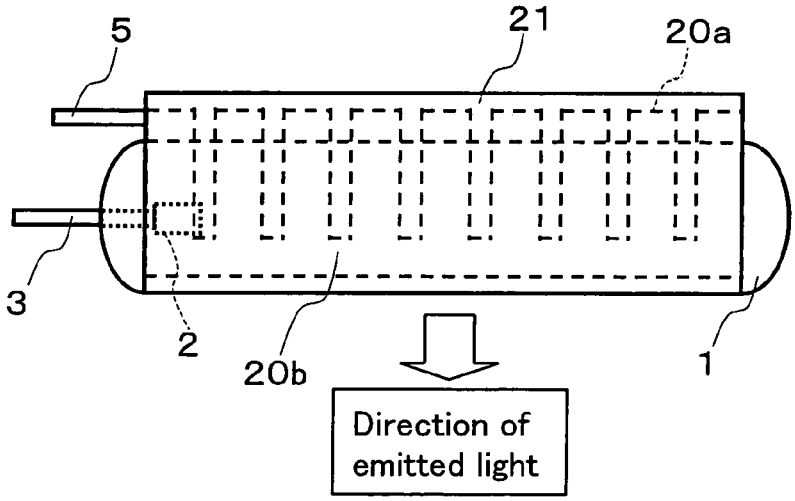
FIG. 4A is an elevational view illustrating a discharge lamp device according to Embodiment 3.
Figure 4B:
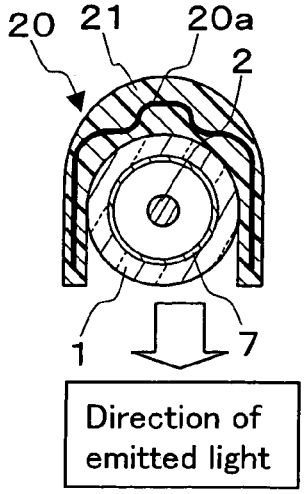
FIG. 4B is a transverse cross-sectional view of the discharge lamp device at its midsection.

FIG. 4A is an elevational view illustrating a discharge lamp device according to Embodiment 3, and FIG. 4B is a transverse cross-sectional view of the discharge lamp device at its midsection. An arc tube 1 has the same configuration as described in Embodiment 1. An external electrode unit 20 is formed inside a dielectric member 21 by insert molding. The external electrode unit 20 has the same configuration as the external electrode unit 4 shown in FIG. 1, in which plural external electrodes 20*a* are linked by linking parts 20*b*.

Like the dielectric material of the engaging member 11 in Embodiment 2, the material of the dielectric member 21 may be a polyester resin having a multilayer film structure, be white, and have a high visible radiation reflectance. The dielectric member 21 has spring characteristics (elasticity), and this elasticity allows the arc tube 1 to be pressed and held by the dielectric member 21. The elasticity of the dielectric member 21 also allows the external electrodes 20*a* to be held and fixed relative to the arc tube 1 reliably.

According to the configuration as described above, the external electrode unit 20 is firmly integrated with the dielectric member 21. Thus, the discharge lamp device can be assembled more easily. Further, attachment accuracy of the external electrodes 20*a* can be maintained more reliably than in Embodiments 1 and 2.

According to the discharge lamp device configured as described above, the same operation and effects as described in Embodiment 1 can be achieved.

Further, since the dielectric member 21 is formed by resin molding, a wide range of thickness control of the dielectric can be performed, whereby the luminous efficiency can be increased easily.

Embodiment 4

Figure 5:
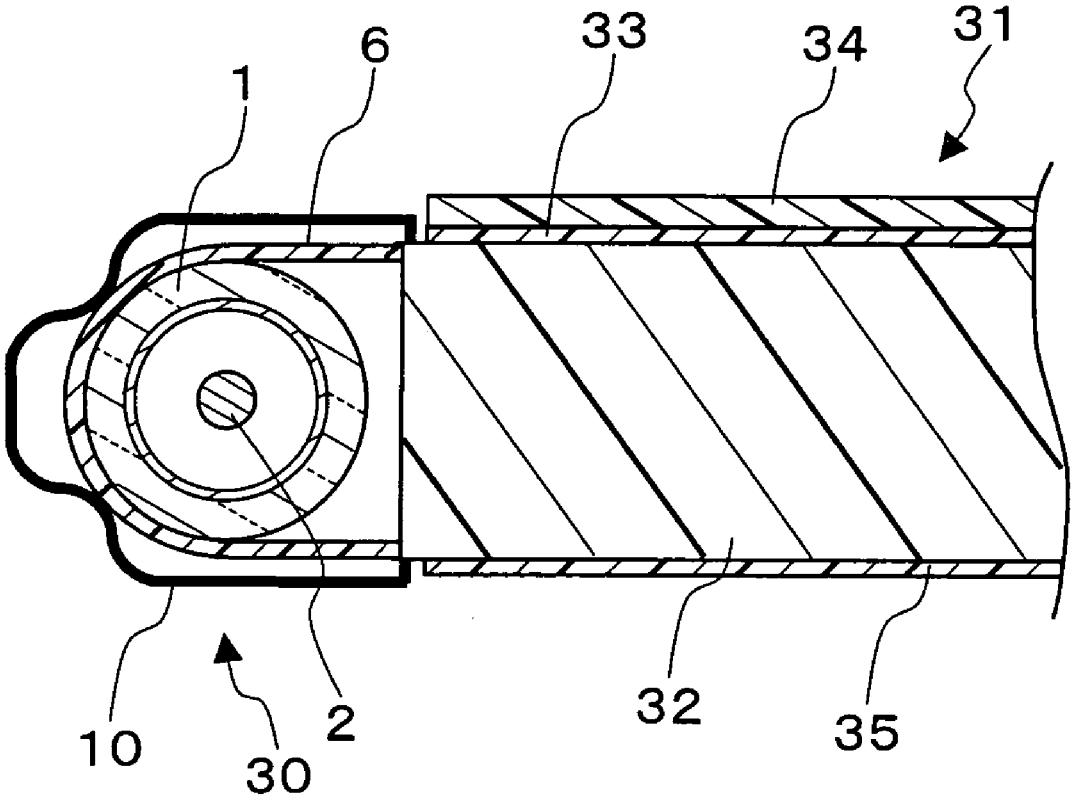
FIG. 5 is a cross-sectional view showing substantial parts of a backlight according to Embodiment 4.

FIG. 5 is a cross-sectional view showing substantial parts of a backlight according to Embodiment 4. A discharge lamp device 30 is arranged at an end surface portion of a light control member 31. The light control member 31 causes light emitted from the discharge lamp device 30 to spread out into a planar form. An external electrode unit in the discharge lamp device 30 is configured as shown in FIG. 1. However, the discharge lamp devices as described in the other embodiments also can be used.

The light control member 31 includes a light guide element 32, a diffusing sheet 33 and a lens sheet 34 arranged on the top surface of the light guide element, and a reflecting sheet 35 arranged on the bottom surface of the light guide element. Light emitted from an arc tube 1 of the discharge lamp device 30 is incident on the end surface of the light guide element 32 and is propagated therethrough. Then, the light is oriented to the top surface by the light guide element 32 and the reflecting sheet 35, is made uniform by the diffusing sheet 33, is enhanced in the directional characteristic by the lens sheet 34, and is emitted to the outside.

Figure 6:
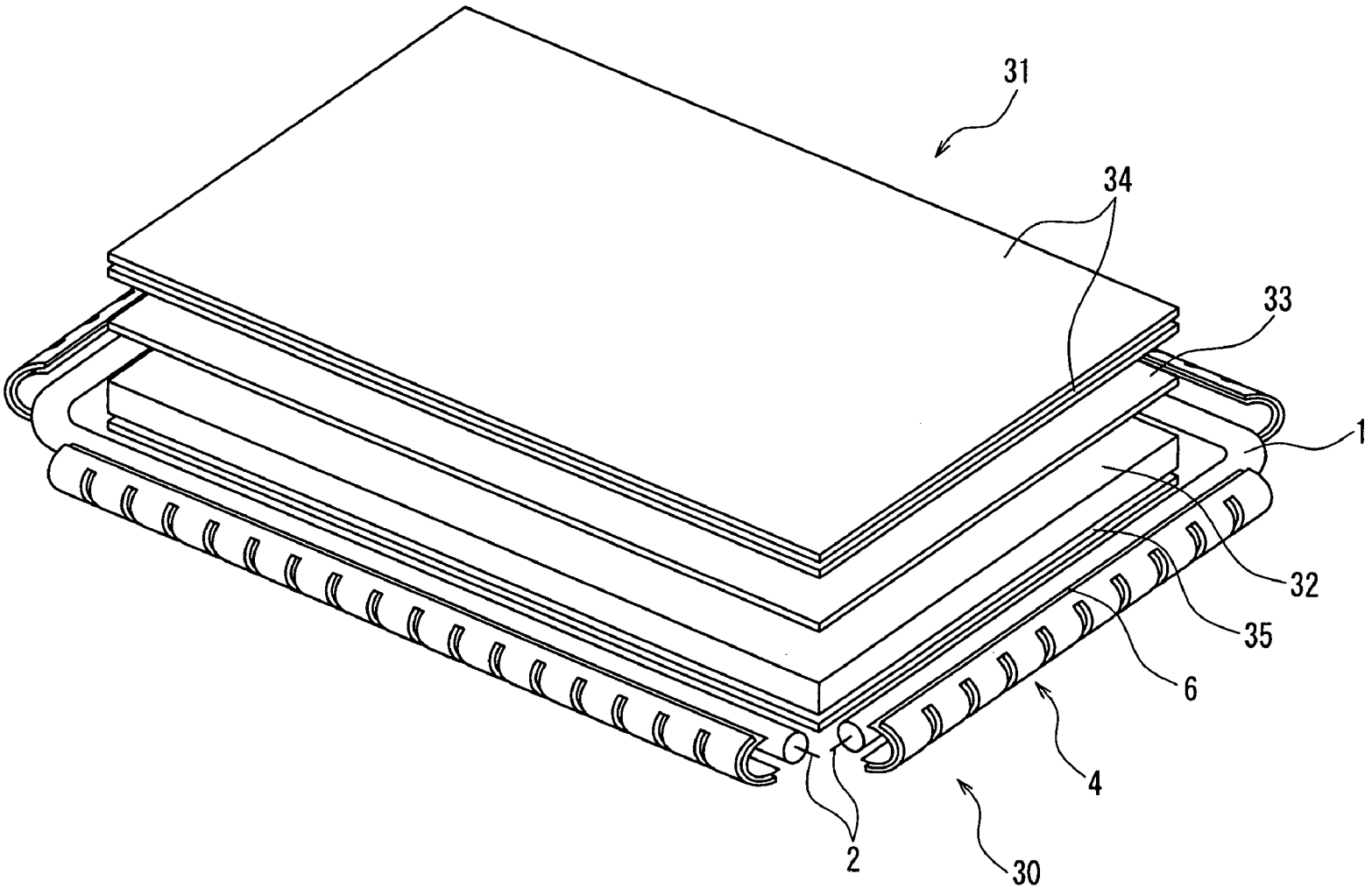
FIG. 6 is an exploded perspective view illustrating the entire configuration of the backlight.
Figure 7:
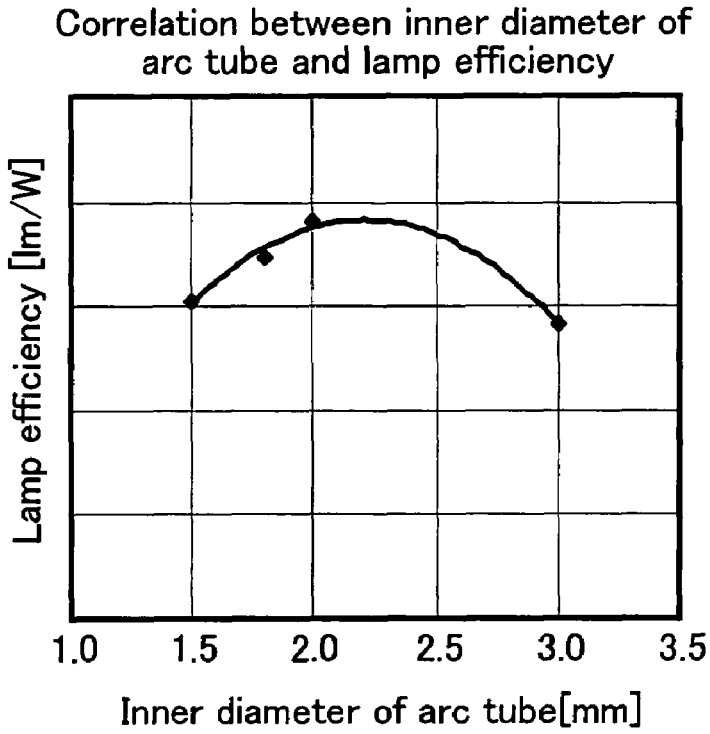
FIG. 7 is a graph showing the correlation between the inner diameter of an arc tube and the lamp efficiency of a typical dielectric barrier discharge lamp.
Figure 8:
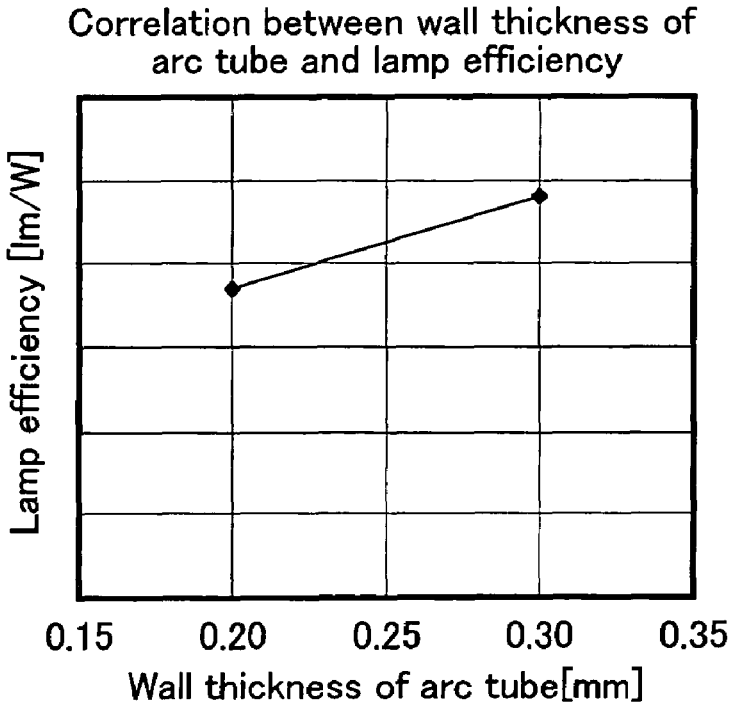
FIG. 8 is a graph showing the correlation between the wall thickness of an arc tube and the lamp efficiency of a typical dielectric barrier discharge lamp.

FIG. 6 illustrates the entire configuration of the thus-configured backlight. This backlight has a pair of discharge lamp devices 30 each formed into an L-shape. By arranging a pair of L-shaped discharge lamp devices 30, light can be incident on all the end surface portions of the light control member 31.

In the discharge lamp device 30, an external electrode unit 4 is divided into two parts and these two parts are attached to the respective sides of the L-shaped arc tube 1. By dividing the external electrode unit 4 in this manner, it can be attached to the arc tube 1 easily. Thus, according to the discharge lamp device of the present embodiment, even when the arc tube has a non-linear shape, the external electrode unit easily can be adapted thereto, which provides a high degree of freedom in backlight configuration.

In the discharge lamp devices of the above-described respective embodiments, the discharge medium further may include mercury. This allows the luminous efficiency and brightness to be increased. Further, at least a part of the dielectric member may be made of a light blocking material, whereby the light blocking effect can be increased. Furthermore, a portion of the dielectric member that is not in contact with the external electrodes may be made of a shielding material, whereby shielding properties can be increased. Moreover, at least a part of the dielectric member may be uneven, whereby heat dissipation properties can be increased. Further, the thickness of the dielectric member may be changed partially, whereby an adjustment for uniform emission can be performed.

In Embodiment 4, the light guide element 32 is used for the light control member 31. However, a light reflector (not shown) may be used in place of the light guide element 32 to achieve the same operation and effects. In this case, a backlight may be configured as follows. A material having high light reflectance is used for the light reflector, a discharge lamp device is arranged at any position on the light reflecting surface side of the light reflector, and a diffusing sheet and a lens sheet are arranged on the light reflector. It generally is known that a backlight using a light reflector can utilize light emitted from a discharge lamp device more efficiently than that using a light guide plate. Thus, it is effective to use a light reflector when the brightness of the emission surface of a backlight is required to be higher.

Further, the discharge lamp device according to the present invention can be applied not only to a backlight for a liquid crystal display or the like, but also to a light source for a scanner, a light source for general lighting, or the like as an independent lamp.

INDUSTRIAL APPLICABILITY

According to a discharge lamp device of the present invention, an external electrode unit integrates external electrodes and can be held around an arc tube by itself. Thus, the external electrodes can be attached to the arc tube easily. In addition, the plural external electrodes can be held relative to the arc tube accurately. Moreover, a dielectric member or the like can be placed between the arc tube and the external electrodes easily.

The invention claimed is:

1. A discharge lamp device, comprising:

a cylindrical arc tube containing a discharge medium;

an internal electrode provided in the arc tube; and an external electrode unit attached to an outside of the arc tube, wherein the external electrode unit includes: external electrodes arranged intermittently at plural places in a direction of a tube axis, each having a part adjoining an outer wall surface of the arc tube; and an engaging part that integrally links the external electrodes, the external electrode unit formed as an electrode member incorporating the external electrodes and the engaging part so as to be shared to cover half or more of the arc tube in a circumferential direction;

a dielectric member interposed between the arc tube and the external electrode unit, the external electrode unit being elastic so as to press the dielectric member against the outer wall surface of the arc tube so as to be held around the arc tube by itself, and a voltage is applied between the internal electrode and the external electrode, thereby lighting the arc tube.

2. The discharge lamp device according to claim 1, wherein the external electrode is made of conductive metal, is attached to an outside of the dielectric member, and has a part in contact with the dielectric member.

3. The discharge lamp device according to claim 1, wherein an area of a portion where the dielectric member and the outer wall surface of the arc tube are in contact with each other is equal to or less than 50% of a surface area of the arc tube.

4. The discharge lamp device according to claim 1, wherein the electrode member incorporating the external electrodes and the engaging part is arranged inside the dielectric member by insert molding.

5. The discharge lamp device according to claim 1, wherein the external electrode unit includes the engaging part made of a dielectric material shaped to cover half or more of the arc tube in a circumferential direction, and the external electrode is held in a central region of the engaging part in a circumference direction of the arc tube.

6. The discharge lamp device according to claim 1, wherein the dielectric member is elastic and presses the outer wall surface of the arc tube.

7. The discharge lamp device according to claim 1, wherein at least a part of the dielectric member reflects light emitted from the arc tube in a specific direction.

8. The discharge lamp device according to claim 1, wherein at least a part of the dielectric member is made of a light blocking material.

9. The discharge lamp device according to claim 1, wherein at least a part of an outer surface of the dielectric member is uneven.

10. The discharge lamp device according to claim 1, wherein a thickness of the dielectric member is changed partially.

11. The discharge lamp device according to claim 1, wherein an interval between the external electrodes in the direction of the tube axis is not less than 1.0 mm nor more than 50 mm.

12. The discharge lamp device according to claim 1, wherein the discharge medium is an inert gas including at least one of xenon, krypton, argon, neon, and helium.

13. The discharge lamp device according to claim 12, wherein the discharge medium further includes mercury.

14. The discharge lamp device according to claim 1, wherein a phosphor layer is adhered to an inner wall surface of the arc tube.

15. A backlight comprising:

the discharge lamp device according to claim 1; and a light control member for causing light generated by the discharge lamp device to spread out into a planar form.

16. The backlight according to claim 15, wherein the light control member is a light guide element or a light reflector.

17. The discharge lamp device according to claim 1, wherein the dielectric member has a lower dielectric constant than that of a glass forming the arc tube.

18. The discharge lamp device according to claim 1, wherein the dielectric member comprises a sheet formed of polyester resin.

* * * * *